United States Patent [19]

Straszewski et al.

[11] 4,217,058

[45] Aug. 12, 1980

[54] RESERVOIR CARTRIDGE FOR WRITING PENS

[75] Inventors: Klaus Straszewski, Quickborn; Jochen Rauterberg, Wedel; Werner Züchner, Hamburg, all of Fed. Rep. of Germany

[73] Assignee: Koh-I-Noor Rapidograph, Inc., Bloomsbury, N.J.

[21] Appl. No.: 945,046

[22] Filed: Sep. 22, 1978

[30] Foreign Application Priority Data

Feb. 3, 1978 [DE] Fed. Rep. of Germany ..... 2804927

[51] Int. Cl.[3] ..... B43K 5/14

[52] U.S. Cl. ..... 401/135; 401/153; 401/157; 215/11 E; 222/327; 222/386.5

[58] Field of Search ..... 401/132–135, 401/143, 153, 157, 156; 215/11 E; 222/327, 386, 386.5

[56] References Cited

U.S. PATENT DOCUMENTS

| | | | |
|---|---|---|---|
| 1,065,872 | 6/1913 | Johnson | 401/143 |
| 1,917,568 | 7/1933 | Wupper | 401/153 |
| 2,061,059 | 11/1936 | Carlson | 401/134 |
| 2,438,786 | 3/1948 | Moore | 401/135 |
| 2,588,829 | 3/1952 | Greist | 401/153 |
| 2,625,302 | 1/1953 | Mahoney | 222/327 |
| 2,726,638 | 12/1955 | Hackmyer | 401/135 |
| 2,878,782 | 3/1959 | Miller | 401/135 |
| 3,061,868 | 11/1962 | Miller | 401/135 |
| 3,087,463 | 4/1963 | Kahn | 401/153 |
| 3,134,362 | 5/1964 | Green | 401/135 |
| 3,134,494 | 5/1964 | Quinn | 215/11 E |
| 3,167,057 | 1/1965 | Bross | 401/135 |
| 3,233,594 | 2/1966 | Zepell | 401/157 |
| 3,250,442 | 5/1966 | Bell et al. | 222/327 |
| 3,421,662 | 1/1969 | Hanson | 222/327 |
| 3,720,473 | 3/1973 | Nakata | 401/40 |
| 3,737,242 | 6/1973 | Hesebeck | 401/157 |
| 4,022,355 | 5/1977 | Sabaka | 222/327 |

FOREIGN PATENT DOCUMENTS

| | | | |
|---|---|---|---|
| 1952108 | 4/1971 | Fed. Rep. of Germany | 401/152 |
| 2003229 | 7/1971 | Fed. Rep. of Germany | 401/133 |
| 1004675 | 4/1952 | France | 401/153 |
| 487742 | 5/1970 | Switzerland | 401/133 |

*Primary Examiner*—William Pieprz

*Attorney, Agent, or Firm*—David H. Semmes; Warren E. Olsen

[57] ABSTRACT

A disposable ink reservoir cartridge which is attachable to tubular writing pens of the stylographic type embodying a pressure compensating chamber. The reservoir cartridge is characterized by its axial deformability, such that the free volume of the reservoir may be reduced, as ink flows from the reservoir into the pressure compensating chamber during pen use. The reduction in free volume of the reservoir eliminates available air space and, thereby, avoids the deleterious effects of air pressure changes upon the ink or writing fluid, as the reservoir is depleted.

2 Claims, 6 Drawing Figures

RESERVOIR CARTRIDGE FOR WRITING PENS

BACKGROUND OF THE INVENTION

1. Field of the Invention

Stylographic writing pens, particularly automatic drafting pens of the type having a tubular writing point, and a pressure compensating chamber and a reservoir communicant with said tubular point. The pressure compensating chamber is provided such that a continuous flow of ink from reservoir to pen tip may be provided, notwithstanding air pressure chambers. A principal shortcoming in such constructions is that the flowing of ink from the reservoir into the pressure chamber, creates a free air volume within the reservoir. This free air volume is subject to air pressure changes and detrimentally affects ink flow, as the reservoir is depleted of ink.

2. Description of the Prior Art

WUPPER; U.S. Pat. No. 1,917,568
MOORE; U.S. Pat. No. 2,438,786
HACKMYER; U.S. Pat. No. 2,726,638
MILLER; U.S. Pat. No. 2,878,782
MILLER; U.S. Pat. No. 3,061,868
KAHN; U.S. Pat. No. 3,087,463
GREEN; U.S. Pat. No. 3,134,362
BROSS; U.S. Pat. No. 3,167,057
NAKATA; U.S. Pat. No. 3,720,473
HESEBECK; U.S. Pat. No. 3,737,242

SUMMARY OF THE INVENTION

The invention refers to a cartridge or reservoir for writing fluid or ink, provided with a connecting area on the front end in order to connect with a writing implement, especially for tubular writing instruments.

Such cartridges for writing fluids are used to a large extent for the reception of ink for tubular writing instruments, and consist generally of plastic. When, during use, the writing fluid flows from the chamber of the cartridge, this writing fluid is replaced by air which enters into the chamber through the existing ink equalizing chamber of the tubular writing instrument.

Whereas the volume of writing fluid or ink in the cartridge or tank changes only slightly during temperature changes, such temperature changes result in considerably higher volume changes with regard to the air which is retained in the writing fluid chamber. Thus, the expanding air both as a result of heating up and of increasing volume, pushes the ink into the writing instrument, via the equalizing chamber in order avoid dripping or smudging. The dimensions of the equalizing chamber have to be such that it can still receive ink under the most unfavorable operating conditions, i.e. when most of the ink in the chamber of the cartridge or tank is replaced by air without letting the writing fluid leak from the equalizing chamber.

If, for example, conventional cartridges or ink reservoirs are used in connection with tubular writing instruments which according to instructions of the manfacturer have to be completely cleaned before inserting a new cartridge of ink, a comparatively large amount of ink emerges from the cartridge immediately after insertion of the cartridge, so as to fill the corresponding parts in the tubular pen body, and to ensure a writing fluid connection between reservoir and pen. Thus, a comparatively large void develops in the cartridge immediately after insertion of the cartridge into the pen. This void is filled with air through the equalizing chamber which ensures pressure balance, notwithstanding temperature changes or volume changes which increase, as more ink is used.

Accordingly, it is the purpose of the present invention to create an ink cartridge or reservoir which will make it possible to considerably lower air volume, resulting from temperature changes. To solve this problem, an ink cartridge of the above mentioned kind is fitted such that the size of the writing fluid receiving volume is variable between a maximum volume, in the case of an ink cartridge, which is not connected with the pen body and a minimum volume, when the cartridge is connected to the pen body, whereby the difference in volume is equated to the volume of ink which has flowed into the pen body. The volume of the ink reservoir of the cartridge is varied by changing the axial length of the reservoir.

The volume of the reservoir can be lowered after insertion into the pen body, so that a balance for ink flowing out of the reservoir and entering the pen body is achieved. Thus, the volume of ink which has flowed out of the reservoir is not replaced by air, rather the volume of the ink reservoir is lowered correspondingly. Thus, immediately after connecting the reservoir to the pen body, there is no air volume in the reservoir which could have an unfavorable effect during temperature changes.

DESCRIPTION OF THE PREFERRED EMBODIMENTS

Figure 1:
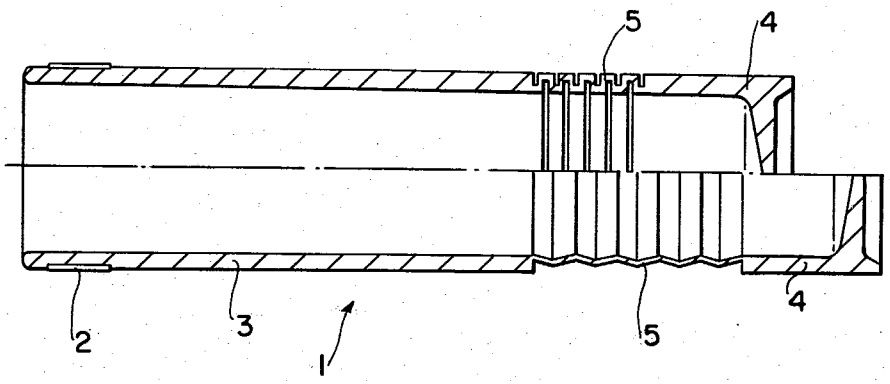
FIG. 1 is a longitudinal section taken through the ink reservoir cartridge, showing at the bottom the cartridge in extended or ink-filled position and at the top in compressed or ink depleted position.

The plastic ink reservoir 1, shown in FIG. 1, is formed in its front end area 3 as a conventional ink reservior for tubular pens, and has in its front end area a metal reinforcing ring 2 which prevents an enlarging of the front end area when the reservoir is inserted into the tubular pen body, and which ensures a sealing fit on the pen body.

Between front area 3 and rear area 4 of reservoir 1, showing an end wall, both consisting of inherently stable plastic, is a bellows-shaped area 5, the shape of which is variable between a pulled out or extended position shown in the lower part of FIG. 1 and a compressed position shown in the upper part of FIG. 1. As can be seen, the change of length of bellows-shaped area 5 makes it possible to lower the volume of the writing fluid chamber from maximum to minimum, such that this volume difference corresponds, as already mentioned, to the volume of ink which has flowed from the reservoir. Reference is made to the fact that bellows-shaped area 5 will retain its compressed position so that after reduction of the volume of the ink, the reservoir volume does not increase again so as to offset the advantageous effect of volume reduction.

Figure 2:
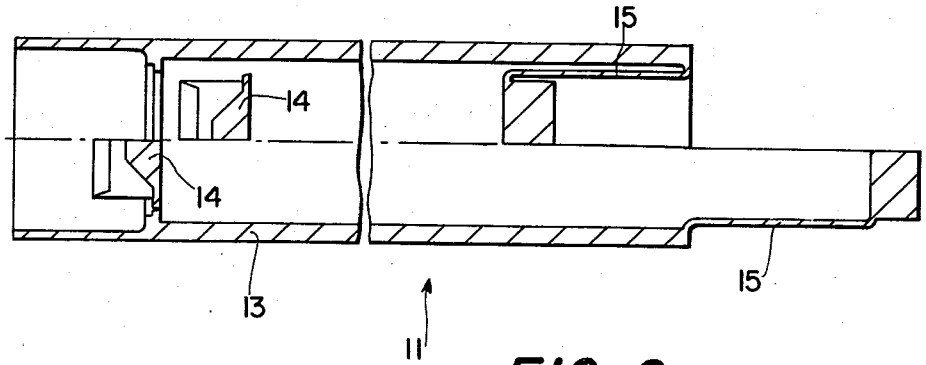
FIG. 2 is a longitudinal section of a modified cartridge, having a telescoping resilient seal, and showing at the bottom the ink-filled or extended position of both rupturable cartridge and deformable seal and in the upper half the compressed position of both rupturable seal and deformable cartridge.

FIG. 2 depicts a modified plastic ink cartridge 11, closed at its forward end with a sealing element 14, which corresponds in its design and operation essentially to the sealing element, disclosed in DE-OS No. 25 59 294. Joined to the inherently stable wall 13 of this ink cartridge is rear area 15, provided with an end wall, the area consisting of a soft deformable material; as shown in the lower part of FIG. 1. Rear area 15 can be inverted from an extended position projected towards the right into the compressed position shown in the upper part of FIG. 2, and can thus be moved into the interior space of the inherently stable section 13. The volume of the reservoir chamber is thereby reduced in a desired manner from maximum to minimum, and the volume difference corresponds to the writing fluid receiving volume of the pen body (not illustrated).

In the filled, unopened position of ink cartridge 11, section 15 is in the position as shown in the lower part of FIG. 2. If the cartridge is inserted into a pen body, the sealing element 14 is pushed inwardly and ruptured open as indicated in the lower part of FIG. 2. Thus the ink within the cartridge is connected with the pen body and the ink can flow into the pen body. Section 15 is now pushed into the position shown in the upper part of FIG. 2, so that ink is pressed into the pen body until its volume is completely filled with ink. Virtually no free air volume exists inside cartridge 11 in this compressed position. Accordingly, there is no air volume which could fluctuate due to temperature fluctuations. Only when ink is actually used will air enter into the cartridge.

Figure 3:
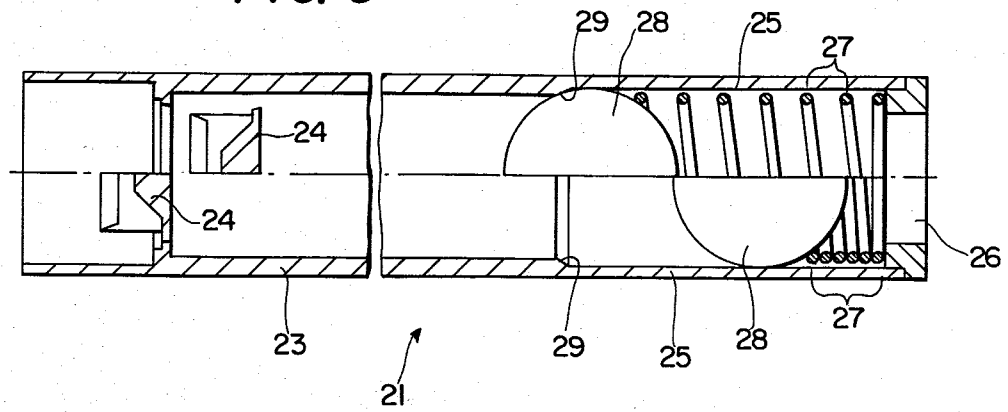
FIG. 3 is a longitudinal section showing further modification having a compression spring and ball detent seal, and showing in the lower half the extended or ink-filled position and in the upper half the compressed or ink depleted position of sealing elements.

The plastic writing fluid or ink cartridge 21, shown in FIG. 3, has in its front end area 23 a sealing element 24 which corresponds with the sealing element in FIG. 2. The rear end of this ink cartridge is closed by means of a vertical end wall 26 which after filling of the cartridge is connected, for example, with wall 25 by gluing or welding. Inside the ink cartridge against the inside of end wall 26 is a compression spring 27 and ball detent 28, which abuts compression spring 27 and is sealing abutment interior shoulder 29.

The ink cartridge in its closed position is filled with enough ink that the ink presses ball 28 against the spring 27 and will have a compressed position, according to the lower part of FIG. 3.

In the writing fluid cartridge 21 is mounted upon a pen body, sealing element 24 is ruptured in the same manner as sealing element 14, according to FIG. 2. Consequently, spring 27 can expand, pushing axially ball 28 and correspondingly, writing fluid is pushed from cartridge 21 into the pen body.

The axial movement of ball 28 under the effect of spring 27 is limited by a annular shoulder 29, which is formed between the front section 23 and rear section 25 of the cylindrical cartridge 21, and against which ball 28 rests in a sealing manner in its axially extended position, as in the upper part of FIG. 3. In this position of the volume, cartridge 21 has been reduced visa-vis the initial volume, according to the lower part of FIG. 3, by a volume which corresponds to the writing fluid receiving volume of the tubular pen body (not illustrated).

Figure 4:
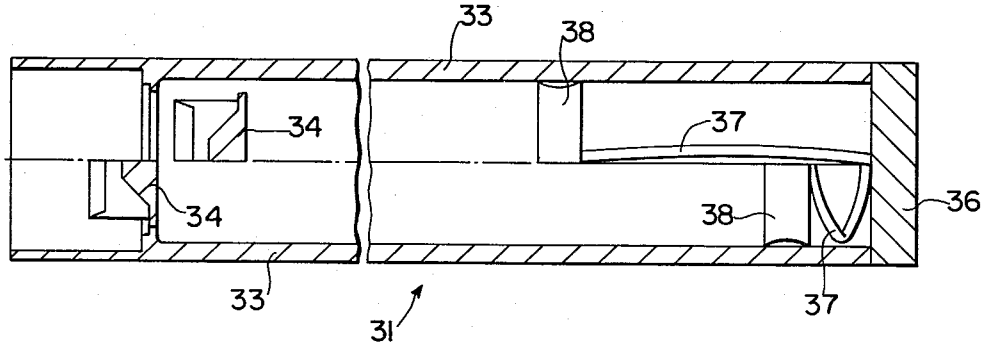
FIG. 4 is a longitudinal section showing a further modification having a spring actuated piston seal, and showing in the lower half, the ink-filled or extended position and in the upper half showing the compressed or ink depleted position.

The plastic ink cartridge illustrated in FIG. 4 corresponds in basic design to the ink cartridge according to FIG. 3, and shows in its front end area a sealing element 34, corresponding to the sealing element 24 of FIG. 3 and to sealing element 14 of FIG. 2. An end wall 36 is fixed to the rear end of cylindrical wall 33; after filling the cartridge 31 with writing fluid end wall 36 is mounted and for example fastened by welding or gluing.

A compression spring 37 consisting of two plastic strips is provided on the inside of end wall 36, the compression spring at its rear end abutting the inside of end wall 36. The front end of the compression spring 37 is connected with unitary piston 38. The plastic piston 38 slides in a sealing manner against the inside of cylindrical wall 33, and while writing fluid cartridge 31 is still closed, is in the position shown in the lower part of FIG. 4.

If the sealing element 34 is opened by inserting the writing fluid cartridge 31 into a pen body, the expanding plastic spring 37 pushes piston 38 forwardly into the position shown in the upper part of FIG. 4. Thus, a portion of the writing fluid flows into the pen body, thereby completely filling the writing fluid reception chamber with writing fluid.

Figure 5:
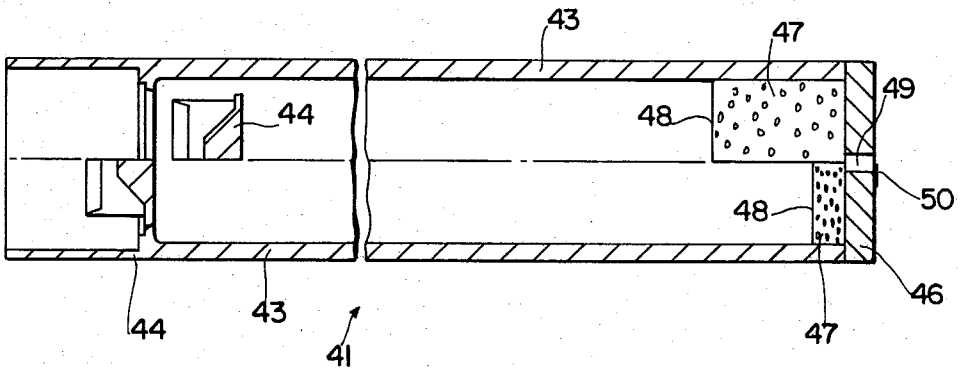
FIG. 5 is a longitudinal section showing a further modification, embodying a compressible foam member, showing in the lower half the ink filled, compressed position and in the upper half the ink depleted, extended position.

FIG. 5 shows another modified plastic writing fluid cartridge 41, the front end of which is closed with sealing element 44 corresponding to the sealing elements in FIGS. 2, 3 and 4. At the rear end of cylindrical wall 43 of cartridge 41 is an end wall 46, secured by welding or gluing, and having an axial opening 49 which, as illustrated in the lower part of FIG. 5, is sealed in a closed position of cartridge 41 with a piece of self-sealing paper or a piece of self-sealing foil 50. A foam pad 47 of open porous material is fitted against the inside of end wall 46; a gasket 48 is fitted to the foam pad on the inner surface, gasket 48 abutting in a sealing manner the inside of cylindrical wall 43 and being movable in an axial direction.

After filling of cartridge 41 with writing fluid, end wall 46 is adjusted with foam pad 47 and gasket 48, whereby the foam pad 47 is compressed due to fluid volume within the cartridge, and will be in the position shown in the lower part of FIG. 5. After attaching the end wall 46, the previously unclosed opening 49 is hermetically sealed with self-sealing foil 50.

When cartridge 41 is inserted into a pen body, the sealing element 44 is opened according to the previously cited examples of operation, and the self-sealing foil 50 may be torn manually from opening 49. Air enters foam pad 47 and abuts gasket 48, therefore pad 47 expands into the position shown in the upper part of FIG. 5, thereby pushing gasket 48, accordingly, and pressing the desired amount of writing fluid into the pen body in order to completely fill its writing fluid chamber.

Figure 6:
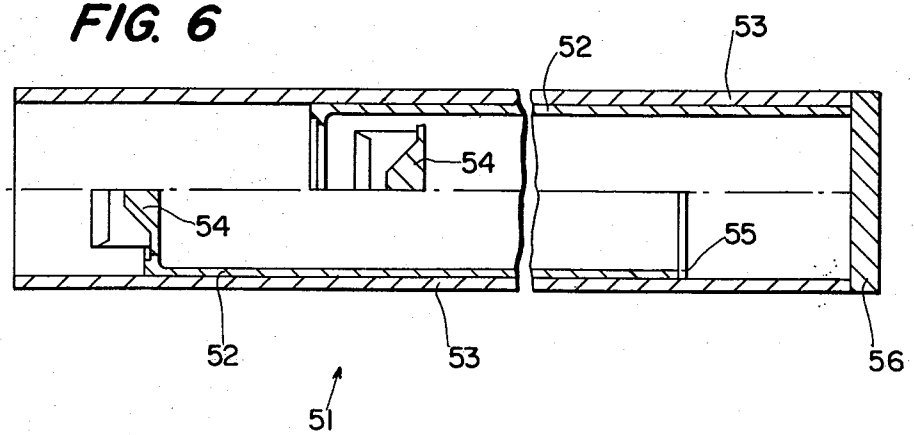
FIG. 6 is a longitudinal section of a telescoping modification, showing in the lower half the rupturable seal in the ink filled position prior to rupturing and in the upper half the seal depleted position having telescoped the inner member to abut the rigid end seal.

The plastic writing fluid cartridge 51, shown in FIG. 6, consists of two parts, an outer part with a cylindrical wall 53 and an end wall 56, and an inner tubular sealing element 52 which is inserted into the outer part. Sealing element 52 has in its front end in the area of the front opening of the outer part a closing element 54, corresponding to the rupturable sealing element illustrated in FIGS. 2 to 5. The open end of the tubular sealing element 52 abuts annular rib 55 which is formed on the inside of the cylindrical wall 53 of the outer part of the cartridge. The outside of the sealing element 52 is telescoped in a sealing manner against the inside of cylindrical wall 53 of the outer part, so that writing fluid will not leak.

If the filled writing fluid cartridge 51 has to be opened, it is inserted into a pen body according to the previously described manner, the pen body opening first the seal 54 and reaching the sealing element 52 until it stops at the outer edge of sealing element 52. If additional pressure with the pen body is exerted onto the sealing element 52, the inner end of the sealing element will slide over annular rib 55 and against end wall 56, as illustrated in the upper part of FIG. 6. Since the pen body fits in a sealing type manner in the front area of the tubular sealing element 52, writing fluid is pressed from the cartridge into the pen body, according to the resulting reduction of volume of the writing fluid chamber upon axially shifting sealing element 52 from the extended position, shown in the lower part of FIG. 6 into the compressed position, shown in the upper part of FIG. 6. This change of volume matches the writing fluid receiving volume of the pen body (not illustrated).

We claim:

1. In a writing pen of the stylographic type having a tubular writing tip, a pressure compensating chamber and an ink reservoir communicant with said tip, the improvements comprising:

(A) An ink reservoir cartridge detachably secured to said pressure compensating chamber and including:

(i) a longitudinally extending closed wall reservior having a frangible end defining an ink flowing aperture, and a closed end enclosing a supply of ink;

(ii) a rupturable seal closing said reservoir at said ink flowing aperture adjacent said pressure compensating chamber, and (iii) a resilient portion of said closed wall supported in said reservoir, said resilient portion being axially movable inwardly within said reservoir towards said ink flowing end to an extent that reduces volume of said reservoir to an equivalent of the volume of ink which has flowed into the pressure compensating chamber, and said resilient portion further including:

(a) a rigid end seal in said outer end, defining an axial opening having a deformable seal affixed thereto, and (b) a compressible foam member abutting said rigid seal within said reservoir, said foam member being impervious to said ink, such that said foam expands axially into said reservoir, so as to reduce volume, as ink flows from said reservoir into the pressure compensating chamber.

2. In a writing pen of the stylographic type having a tubular writing tip, a pressure compensating chamber and an ink reservoir communicant with said tip, the improvements comprising:

(A) An ink reservoir cartridge detachably secured to said pressure compensating chamber and including:

(i) a longitudinally extending closed wall reservoir having a frangible end defining an ink flowing aperture, a closed end enclosing a supply of ink and an intermediate inwardly projecting shoulder defined adjacent said closed end;

(ii) a rupturable seal closing said reservoir at said ink flowing aperture adjacent said pressure compensating chamber, and (iii) a resilient portion of said closed wall supported in said reservoir at said closed end, said resilient portion being axially movable, so as to reduce the volume of said reservoir, as ink flows from said reservoir into the pressure compensating chamber, said resilient portion being axially movable inwardly within said reservoir to an extent that reduces volume of said reservoir to an equivalent of the volume of ink which has flowed into the pressure compensating chamber; said resilient portion further including:

(a) a rigid end closure supported at said outer end, and (b) a telescoping inner sleeve supporting said rupturable seal and mounted in said reservoir in abutment with said inwardly projecting shoulder defined in said outer end, and said sleeve overriding said shoulder to abut said rigid end closure, as said rupturable seal is ruptured and compressed inwardly towards said rigid end closure.

* * * * *